US008763348B2

(12) United States Patent
Combrink

(10) Patent No.: US 8,763,348 B2
(45) Date of Patent: Jul. 1, 2014

(54) PACKING UNIT

(75) Inventor: Alois Combrink, Oelde (DE)

(73) Assignee: Haver & Boecker OHG, Oelde (DE)

( * ) Notice: Subject to any disclaimer, the term of this patent is extended or adjusted under 35 U.S.C. 154(b) by 712 days.

(21) Appl. No.: 12/989,000

(22) PCT Filed: Apr. 21, 2009

(86) PCT No.: PCT/EP2009/002894
§ 371 (c)(1),
(2), (4) Date: Nov. 9, 2010

(87) PCT Pub. No.: WO2009/129995
PCT Pub. Date: Oct. 29, 2009

(65) Prior Publication Data

US 2011/0047942 A1 Mar. 3, 2011

(30) Foreign Application Priority Data

Apr. 22, 2008 (DE) ..... 10 2008 020 256

(51) Int. Cl.
*B65B 3/04* (2006.01)
*B65B 39/06* (2006.01)
*B65B 39/14* (2006.01)
*B65B 43/46* (2006.01)

(52) U.S. Cl.
CPC ..... *B65B 43/465* (2013.01); *B65B 39/14* (2013.01)
USPC ..... 53/284.7; 53/237; 53/240; 53/249; 53/570

(58) Field of Classification Search
USPC ..... 53/284.7, 202, 237, 240, 249, 276, 570, 53/502, 239, 247, 26, 268, 55, 384.1
See application file for complete search history.

(56) References Cited

U.S. PATENT DOCUMENTS

| | | | | | |
|---|---|---|---|---|---|
| 2,144,569 | A | * | 1/1939 | Frazier | 222/185.1 |
| 3,851,444 | A | * | 12/1974 | Merat | 53/167 |
| 4,074,507 | A | * | 2/1978 | Ruf et al. | 53/502 |
| 4,092,721 | A | * | 5/1978 | Rueff et al. | 700/240 |
| 4,137,689 | A | * | 2/1979 | McClusky et al. | 53/502 |
| 4,162,602 | A | * | 7/1979 | Achelpohl et al. | 53/415 |
| 4,269,016 | A | * | 5/1981 | Kopp et al. | 53/546 |
| 4,548,286 | A | * | 10/1985 | Sashiki et al. | 177/1 |
| 4,553,617 | A | * | 11/1985 | Tatematsu | 177/25.18 |
| 4,629,017 | A | * | 12/1986 | Shroyer | 177/25.18 |

(Continued)

FOREIGN PATENT DOCUMENTS

| | | | |
|---|---|---|---|
| DE | 10 96 820 | B | 1/1961 |
| EP | 1 792 830 | A | 6/2007 |
| GB | 2 078 191 | A | 1/1982 |

*Primary Examiner* — Gloria R Weeks
(74) *Attorney, Agent, or Firm* — Pearne & Gordon LLP

(57) ABSTRACT

Packing unit (1) with a packing machine (2) for filling bulk materials (3) in open sacks with a sack suspension device (7), for suspending the open sacks at a filling nozzle (8-10) of a product supply device (11, 13) and filling the same with at least one bulk material. The sack suspension device is provided with at least two selectable product supply devices. The at least two product supply devices and the sack suspension device are movable relative to each other in order to select a product supply device and to suspend a sack by means of the sack suspension device at the filling nozzle of the selected product supply device and to fill bulk material in the open sack by means of the corresponding filling nozzle.

10 Claims, 3 Drawing Sheets

(56) References Cited

U.S. PATENT DOCUMENTS

| | | | | | |
|---|---|---|---|---|---|
| 4,657,094 | A | * | 4/1987 | Mosher et al. | 177/50 |
| 4,674,259 | A | * | 6/1987 | Hills | 53/202 |
| 4,959,947 | A | * | 10/1990 | Reif | 53/502 |
| 5,082,032 | A | * | 1/1992 | Crocker | 141/1 |
| 5,380,957 | A | * | 1/1995 | Giles | 177/16 |
| 5,443,102 | A | * | 8/1995 | Svendsen | 141/10 |
| 5,452,567 | A | * | 9/1995 | Lieder | 53/570 |
| 5,626,004 | A | * | 5/1997 | Gates et al. | 53/459 |
| 5,690,283 | A | * | 11/1997 | Sandolo | 241/34 |
| 5,752,371 | A | * | 5/1998 | Mosley | 53/570 |
| 5,765,335 | A | * | 6/1998 | Simionato | 53/154 |
| 6,000,200 | A | * | 12/1999 | Germunson et al. | 53/502 |
| 6,035,607 | A | * | 3/2000 | Miller | 53/266.1 |
| 6,119,440 | A | * | 9/2000 | Benner et al. | 53/473 |
| 6,145,709 | A | * | 11/2000 | Hogan et al. | 222/278 |
| 6,216,753 | B1 | * | 4/2001 | Kanzler et al. | 141/313 |
| 6,321,506 | B1 | * | 11/2001 | Rolland | 53/53 |
| 6,550,226 | B1 | * | 4/2003 | Gates et al. | 53/459 |
| 6,725,889 | B2 | * | 4/2004 | Perez Vales | 141/104 |
| 6,779,321 | B1 | * | 8/2004 | Kelemen | 53/567 |
| 6,823,654 | B2 | * | 11/2004 | Gates et al. | 53/573 |
| 7,021,036 | B2 | * | 4/2006 | Hiramoto et al. | 53/562 |
| 7,337,594 | B2 | * | 3/2008 | Sus et al. | 53/495 |
| 7,574,844 | B2 | * | 8/2009 | Kamineni | 53/415 |
| 7,877,966 | B2 | * | 2/2011 | Knoke et al. | 53/469 |
| 8,245,485 | B2 | * | 8/2012 | Fukeda et al. | 53/95 |
| 2004/0182469 | A1 | * | 9/2004 | Concetti | 141/10 |
| 2005/0087562 | A1 | * | 4/2005 | Koide et al. | 222/252 |
| 2011/0107730 | A1 | * | 5/2011 | Scott | 53/570 |

* cited by examiner

PACKING UNIT

FIELD OF THE INVENTION

The present invention relates to a packaging system with a packaging machine for filling sacks with bulk materials providing in particular a plastic sheet reservoir and a sack forming device for manufacturing from the plastic sheet, open sacks to be filled subsequently.

DESCRIPTION OF RELATED ART

These packaging systems or packaging machines are called form-fill-seal machines or FFS machines and are employed for filling bulk materials into open sacks. The sacks manufactured from plastic sheet may be provided with gussets to ensure good stackability. In manufacturing the open sacks are first sealed at their lower ends and after filling, sealed at their top ends.

FFS machines tend to be employed for bagging plastic granules and powdered products such as construction materials. Both dusting products and grainy or granular products can be bagged.

A significant criterion for the cost-effectiveness of an FFS machine is the quantity of bags filled per day which is influenced by the filling rate of the packaging machine and any idle times. Idle times occur in particular when changing the filled product since the product path coming into contact with the product requires cleaning to avoid cross-contamination of the products.

These cleaning procedures can be quite time-consuming so as to reduce the production output of the machine.

To increase productivity, two machines may be employed bagging for example different products. The drawback of this is the high financial charge and increased floor space requirement.

SUMMARY OF THE INVENTION

It is therefore the object of the present invention to provide a packaging machine allowing high output.

This object is solved by a packaging machine having the features of claim 1. Preferred embodiments of the invention are the subjects of the subclaims. Further advantageous features and configurations of the invention are illustrated in the exemplary embodiment.

The packaging system according to the invention is provided with a packaging machine for filling bulk materials into open sacks and with a sack attachment device to attach the open sacks to a filling port of a product feeding device and to fill the open sacks with at least one bulk material.

At least two selectable product feeding devices are assigned to a sack attachment device and the at least two product feeding devices and the sack attachment device are positioned movable relative to one another to select a product feeding device and to attach a sack to the filling port of the selected product feeding device by means of the sack attachment device and to fill bulk materials into the open sack by means of the associated filling port.

The packaging system according to the invention has many advantages. One significant advantage of the packaging system according to the invention is the fact that idle times can be considerably reduced since any one of the two or more product feeding devices may be selected and no cleaning times occur. Reducing the idle times in product changes significantly increases capacity in particular in the case of frequent changes of the materials to be bagged.

For example if the packaging system is installed in a production area involving regular product changes, cross-contamination of the different products to be bagged can be reliably avoided by way of changing the product feeding device following the bagging of a first product to be filled before bagging a second product.

Changeover of the product feeding device of the packaging system according to the invention simply occurs by activating another product feeding device for a second product to be bagged by way of moving a product feeding device relative to the sack attachment device.

By means of moving the product feeding device relative to the sack attachment device another product feeding device is brought to the filling position and another product may be bagged by the packaging system without consuming much time and without involving a risk of contamination.

No time-consuming cleaning of the product feeding device is required before having the machine operation continue following a product change. Any cleaning required of the product feeding device employed for bagging a first product may occur while a second product is bagged using a second product feeding device.

In the case that bagging of a first and a second product often alternates, a specific product feeding device may be selected for each product such that virtually no cleaning is required other than scheduled cleaning of the product feeding device. At any rate, the packaging system can continue operating notwithstanding frequent product changes without involving substantial idle times.

This offers considerable time savings since these kinds of systems always require relatively much work to ensure the cleanliness required since cleaning as a rule involves compressed air, water, or brushes. Although the cleaning process often occurs manually it may be automated. In conventional systems even automatic cleaning involves the drawback that despite the installed and/or the personnel requirements much idle times ensue which critically reduce the productivity of conventional filling systems.

The financial advantages are quite considerable compared to the solution of maintaining separate packaging systems for each product, and the space requirement is considerably reduced as well. Moreover if many different kinds of products are to be bagged it is virtually impossible to install a separate packaging system for each product.

The present invention offers the advantage over the prior art that two, three or more product paths are utilized one of which is selected and used for filling at a time.

In a preferred more specific embodiment a blown sheet reservoir and a sack forming device are provided to continuously manufacture open bags from the blown sheet as needed. The packaging machine is in particular equipped with a sack attachment device. Preferably a sack discharging device may be provided for conveying the filled bags off.

A picking device may be provided to grip single bags from a stack of bags and attach those to a filling port by means of the sack attachment device.

These configurations are very advantageous since the packaging machine may still be comparatively simple in structure, for example not comprising product feed.

Preferably the product feeding device comprises a filling channel and a filling port. The filling channel may comprise an acceleration line or be configured as an acceleration channel. A product feeding device equipped with a filling channel and a filling port is very advantageous since this provides a filling system which only requires that an open bag be attached for bagging.

When two or more of these product feeding devices are provided, one of the product feeding devices may be selected by a simple movement of the sack attachment device relative to a product feeding device such that for example in the case of a product change, filling of bulk materials into open bags can continue without involving particular delays for example after a sack attachment device was shifted to another product feeding device.

While a second product is being bagged, the first product feeding device may be cleaned if required. Such cleaning, however, does not involve any idle time of the entire machine.

A gross weighing machine may be assigned at least to the filling port of one product feeding device such that the bulk material is being weighed while being filled into the bag and the filling process can be controlled in dependence on the determined filled weight.

Preferably at least one product feeding device is provided with clamping devices to retain an open bag to be filled at the filling port.

In the case that a gross weighing machine is used, the clamping devices are included in the weight. For example a part of the filling port with the clamping devices may form the weighed system the weight of which is determined continuously or periodically by the gross weighing machine.

It is also possible and preferred that a net weighing machine is assigned to at least one product feeding device or that at least one product feeding device comprises a net weighing machine, wherein in particular the net weighing machine is followed by an acceleration line to allow efficient filling of the bulk material into the open bag. In the case of a net weighing machine the precise quantity of the product to be bagged is first weighed in a container and thereafter the content of the container is conveyed into the open bag.

In preferred embodiments, product feed may be provided with a net weighing machine while another product feed is equipped with a gross weighing machine so as to also allow packaging systems in which net weighing machines or gross weighing machines are provided as specific products require.

According to a particularly preferred configuration at least one product feed is provided stationary on an in particular stationary silo. In this configuration all the product feeding devices are preferably provided stationary. The movement of the sack attachment device relative to the product feeding device preferably occurs such that the packaging machine moves relative to the intended product feeding device.

For example the packaging machine may be provided movable and in particular traversable from at least one first product feeding device provided with a filling port to at least one second product feeding device provided with a filling port.

It is also possible for the packaging machine to be movable relative to a plurality of different product feeding devices with the packaging machine being provided for example on a rail system to ensure defined movability of the packaging machine. Or else it is possible for the packaging machine to be provided for manual or automatic traversing via a kind of air cushion or via wheels or the like.

In these configurations the packaging machine comprises the blown sheet reservoir and the bag forming device and the sack attachment device which attaches the open bag manufactured by the bag forming device to the filling port of a selected product feeding device. Then the product feeding device and the assigned filling port are no components of the packaging machine but so to speak arranged separately therefrom. In these configurations the packaging machine as a rule furthermore comprises a bag discharging device for conveying the filled bags off.

The packaging machine in particular comprises doors which are closed while the bulk material is being filled into the open bags to ensure personnel protection and noise damping. To transfer the packaging machine from a first position assigned to a first product feeding device to a second position assigned to a second product feeding device, the doors are preferably opened.

In another configuration the product feeding devices are provided mobile and moveable and in particular traversable relative to the packaging machine. Herein at least one first mobile product feeding device provided with a filling port and at least one second product feeding device provided with a filling port are disposed which are traversable relative to the packaging machine to selectively employ the first or the second or another mobile product feeding device for bagging bulk materials.

This configuration has again considerable advantages since in product changes another product feeding device is brought to a filling position so as to allow cleaning of the first product feeding device while another bulk material is bagged by means of the second product feeding device.

Preferably the first and at least one second mobile product feeding device are provided on one joint traversing device. Although the traversing device may in particular be provided for linear traversing it may be provided to be rotational or pivotal.

A joint traversing device received in a guide offers the advantage that a simple, defined movement of the traversing device selects another product feeding device.

In these configurations it is preferred for a second mobile product feeding device to be located in a cleaning position while the first mobile product feeding device is located in the filling position.

The traversing distance of the mobile product feeding devices may be for example 20, 40 or 60 cm, or else it may be longer.

It is also possible for at least one mobile product feeding device to comprise a flexible filling channel provided stationary at the upper end and whose lower end is movable from a home position to a filling position. Then it is for example possible for the upper ends of different mobile product feeding devices to be connected with a corresponding silo outlet while the other end of the assigned filling channel is guided to the filling position to select a specific product.

In all of the configurations it is possible for at least one product feeding device to comprise a filling valve configured for example as a closing device to prevent product particles from running out.

It is furthermore possible for all of the configurations to be provided with at least one compacting device e.g. in the shape of a vibrating device. A vibrating device may for example be provided at the packaging machine, supporting the bag while vibrating during or after the filling operation. When bagging according to the net weighing principle, the compacting device may be operated during the filling operation. When bagging with a gross weighing machine the vibrating device may support the bag while vibrating after the filling operation to assist with air discharge.

When bagging according to the net weighing principle the product feeding device concerned may have a vibrating lance or a vacuum lance assigned to it which is immersed in the open bag from above during filling.

Preferably at least one separate sealing station is provided. In simple configurations manual placement of open bags is possible.

BRIEF DESCRIPTION OF THE DRAWINGS

Further advantages and applications of the present invention follow from the description of two embodiments which will now be explained with reference to the enclosed figures.

The figures show in.

DETAILED DESCRIPTION OF THE INVENTION

With reference to the FIGS. 1 to 5, exemplary embodiments of a packaging system 1 each comprising a packaging machine 2 will now be explained.

The exemplary embodiments share the attribute that at least two product feeding devices each are provided disposed traversable relative to the sack attachment device which is assigned for example to the packaging machine 2.

Figure 1:
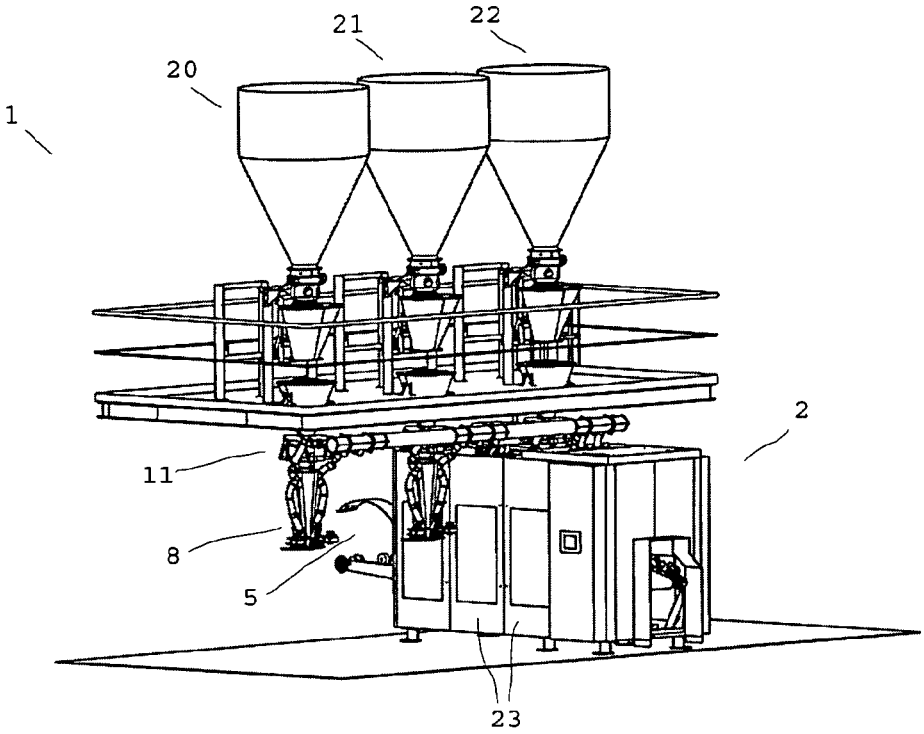
FIG. 1 a perspective view of a first embodiment of a packaging system according to the invention.
Figure 2:
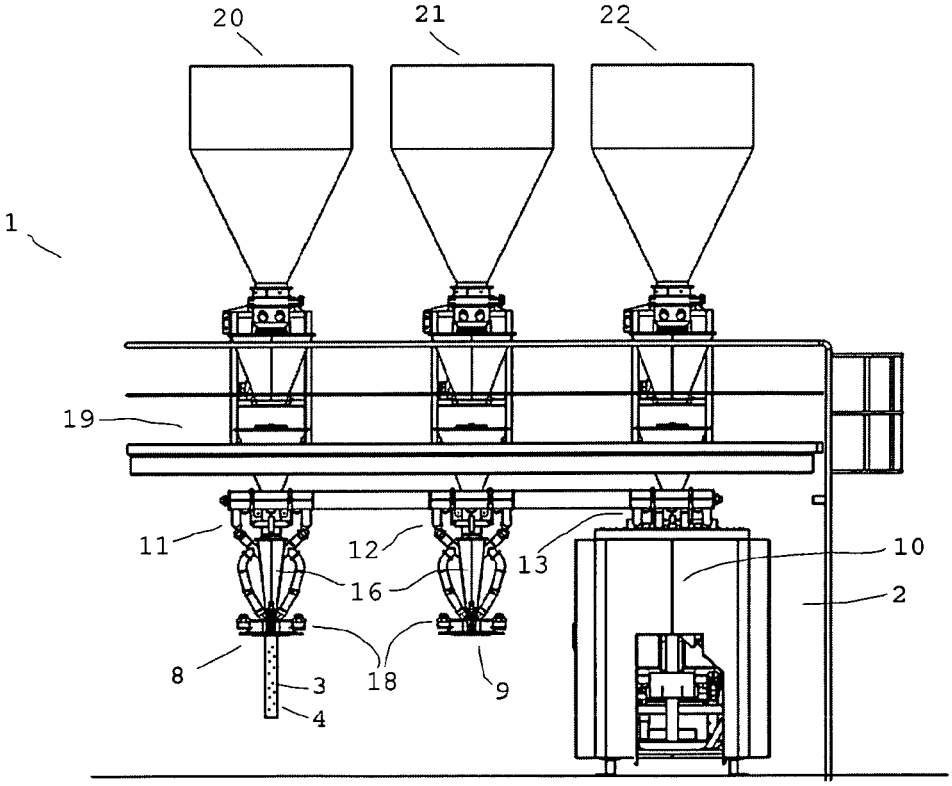
FIG. 2 a side view of the packaging system according to FIG. 1.

In the embodiment illustrated in the FIGS. 1 and 2 the product feeding devices 11-13 are provided stationary and immediately connected with the silos 20, 21 and 22. Each of these product feeding devices 11, 12 and 13 comprises a net weighing machine 19 the product outlet of which opens into a filling channel 15 which presently acts as an acceleration channel 16 to rapidly and efficiently fill the bulk materials 3 to be bagged into an open sack 4.

Although the packaging machine 2 in the illustration according to FIG. 2 beneath the silo 22 is assigned to the product feeding device 13 and the product feeding devices 11 and 12 at the silos 20 and 21 are not in operation in the state shown in FIG. 2, FIG. 2 schematically illustrates at the filling port 8 an open sack 4 that is filled with a bulk material 3 so as to illustrate the principle.

If required it is possible to manually place bags on the filling ports 8-10, for example for filling only a few bags in case it is not worthwhile to position a packaging machine 2 for a small quantity. Optionally a mobile sealing station may be provided for sealing the manually placed bags after the filling operation.

In the embodiment according to the FIGS. 1 and 2 the packaging machine is provided mobile and in particular traversable and it may be shifted to the filling ports 8, 9 or 10, to alternatingly, selectively bag the products contained in the silos 20, 21 and 22.

In the case of frequent product changes this can occur fast and easily according to embodiment according to the FIGS. 1 and 2. Before the packaging machine 2 is traversed, the door 23 is opened for the filling port hanging down from the frame to be inserted into the machine.

The packaging machine 2 is traversed to the provided filling position and the filling operation can restart with the next product. Cleaning is basically not required before filling with a next product if the product in the associated silo does not change.

To further simplify product changes, the packaging machine 2 may be disposed on a not illustrated rail system provided with suitable markings or the like to ensure reliable positioning of the packaging machine 2.

The present packaging machine 2 is configured simple and comprises a blown sheet reservoir 5 in which one or possibly two blown sheet rolls with an automatic changing device are provided to ensure continuous operation. The tubular sheet is unwound from the sheet roll of the sheet reservoir 5 and disposed one by one in a bag forming device 6 at the beginning of the machine and a bottom seam is made for the next bag. The desired bag length is cut and the bag is attached to a filling port of a product feeding device 11-13 by means of a sack attachment device 7 (see FIGS. 3 and 4).

The port configured in particular hexagonal comprises clamping devices 18 by means of which the bag is placed snug on the port and is also held on the sides.

Bagging is possible both according to the net weighing method and according to the gross weighing method. With the gross weighing method the filling port is weighed with the bag attached while the bulk material is being filled in to control the filling process weight-related. The weighed part of the filling port is separated from the remainder of the filling port by means of a compensator.

As the specified total weight is reached the filling process, which may be divided up into coarse stream and fine stream phases for better control, is stopped. As the provided target weight is reached, the metering device closes off the further product feed and the bag 4 can be taken off one of the filling ports 8-10 and following compaction that may occur by means of a vibrating device it may be sealed at its top end by means of a sealing device. Thereafter the bag 4 is conveyed towards a bag discharging device 14 and leaves the machine.

Utilizing the principle illustrated in the FIGS. 1 and 2 allows to combine not only two or three product feeding devices with a packaging machine to obtain a packaging system, but a plurality of product feeding devices may be combined with a plurality of mobile packaging machines such that using four, five or ten or more product feeding devices allows to bag a corresponding number of different bulk materials wherein each provided packaging machine can be shifted to a corresponding product feeding device as needed. In this way not only one product but multiple products may be bagged concurrently. One significant advantage is that the system is greatly extensible since firstly only one packaging machine may be employed which may be supplemented by a second or a third packaging machine as needed until products are bagged for example from ten silos.

Figure 3:
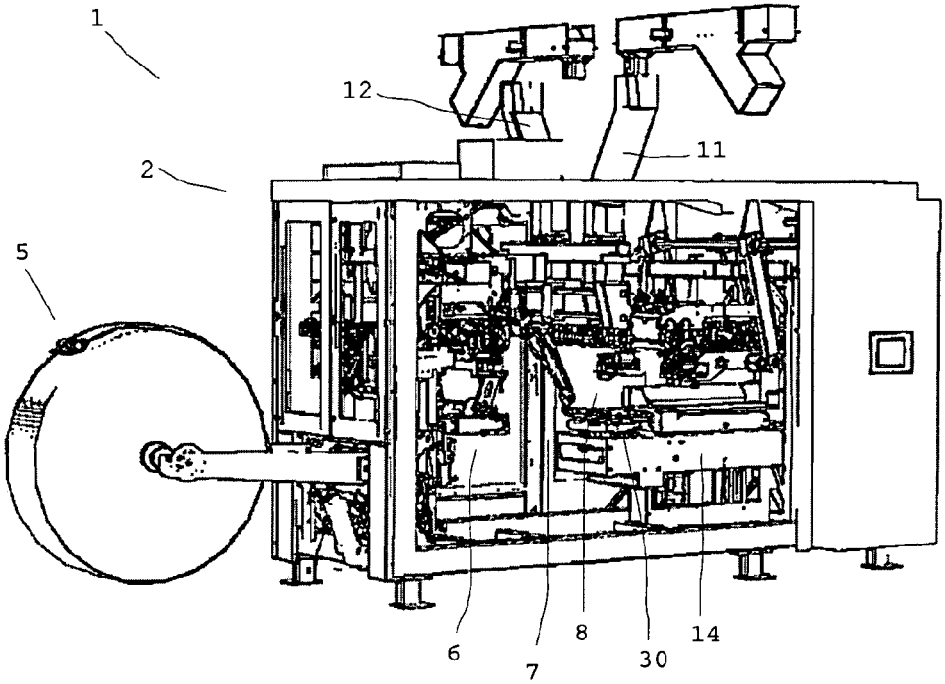
FIG. 3 a perspective view of another embodiment of a packaging system according to the invention.
Figure 4:
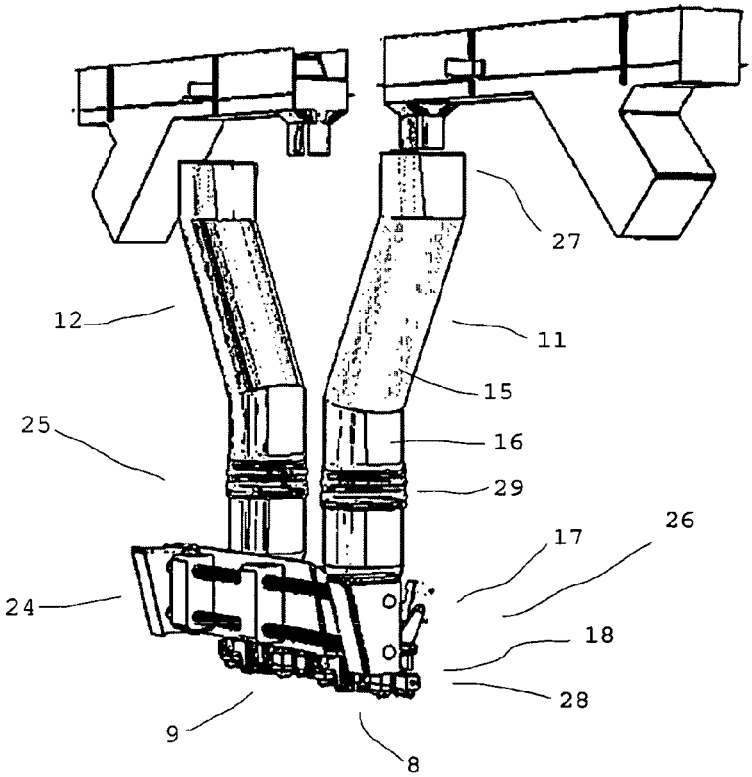
FIG. 4 the traversable product feeding devices of the packaging system according to FIG. 3, and FIG. 5 a side view of a pair of flexible product feeding devices.

FIGS. 3 and 4 illustrate another embodiment of a packaging system 1 according to the invention comprising a packaging machine 2. This packaging machine 2 is configured as a stationary packaging machine which as a rule is set up once to then stay in place.

The packaging machine 2 according to FIG. 3 again comprises a blown sheet reservoir 5 at which one or possibly more blown sheet rolls may be provided to allow continuous or quasi continuous filling of the bulk material 3 into open bags 4.

The blown sheet is unwound from the blown sheet reservoir 5 and introduced into the machine where a piece of blown sheet is singled out in the bag forming device 6 and made into an open bag 4.

Both the embodiments according to FIGS. 3 and 4 and according to FIGS. 1 and 2 allow to employ both gusseted blown sheets and simple tubular sheets.

The open bag 4 manufactured in the bag forming device 6 is transported to a filling port 8 of a product feeding device 11 by means of a sack attachment device 7 and it is in particular attached to the filling port 8 by means of the sack attachment device 7. At the filling port 8 the open bag 4 is clamped tight to the filling port which is again preferably hexagonal in cross-section and substantially dustproof, by means of clamping devices 18. This allows bagging easily flowing and dusting products without contaminating the packaging machine 2 or the ambience.

In the embodiment according to FIG. 3 the filling operation may occur alternatingly by means of the product feeding device 11 or by the product feeding device 12 both of which comprise a filling channel 15 with an acceleration channel 16. The lower ends of the product feeding devices 11 and 12 in the embodiment according to FIG. 3 are provided with filling ports 8 and 9. Other configurations allow to provide more than two product feeding devices for one packaging machine 2.

In the present embodiment the product feeding devices 11 and 12 are held on one shared traversing device 24 where they are positioned displaceably and transverse to the longitudinal extension of the packaging machine 2. The product feeding devices 11 and 12 may be provided for both manual and automatic displacement.

In the state illustrated in FIG. 3 the product feeding device 11 is located in the filling position 26 to which end the silo outlet is disposed above the upper end 27 of the product feeding device 11.

In this embodiment bagging is again possible both according to the net weighing method and according to the gross weighing method.

Presently, weighing devices are provided at the filling ports 8 and 9 such that a gross weighing machine 17 is present. Filling valves in the filling channels 15 may be provided for closing the filling channels to control product feed as necessary and to close the filling channels during non-use to prevent powdery, grainy, or dusting products from running down.

Beneath the filling position 26 a vibrating device 30 is provided which when a net weighing machine is used applies a vibrating movement to the bag 4 already during the filling operation or when a gross weighing method is employed, applies a vibrating movement to the bag after the filling operation has ended to de-aerate the bag before sealing.

The embodiment according to the FIGS. 3 and 4 allows for one product feeding device 11 to be in the filling position 26 while the other product feeding device 12 is located in the cleaning position 25 in which the filling channel including the filling port can be thoroughly cleaned from product residue to prevent contamination of a product to be bagged later. For example while the product feeding device 12 is being cleaned, the product feeding device 11 may already be bagging another product. Thus the idle times in product changes are minimized or at least considerably reduced.

Figure 5:
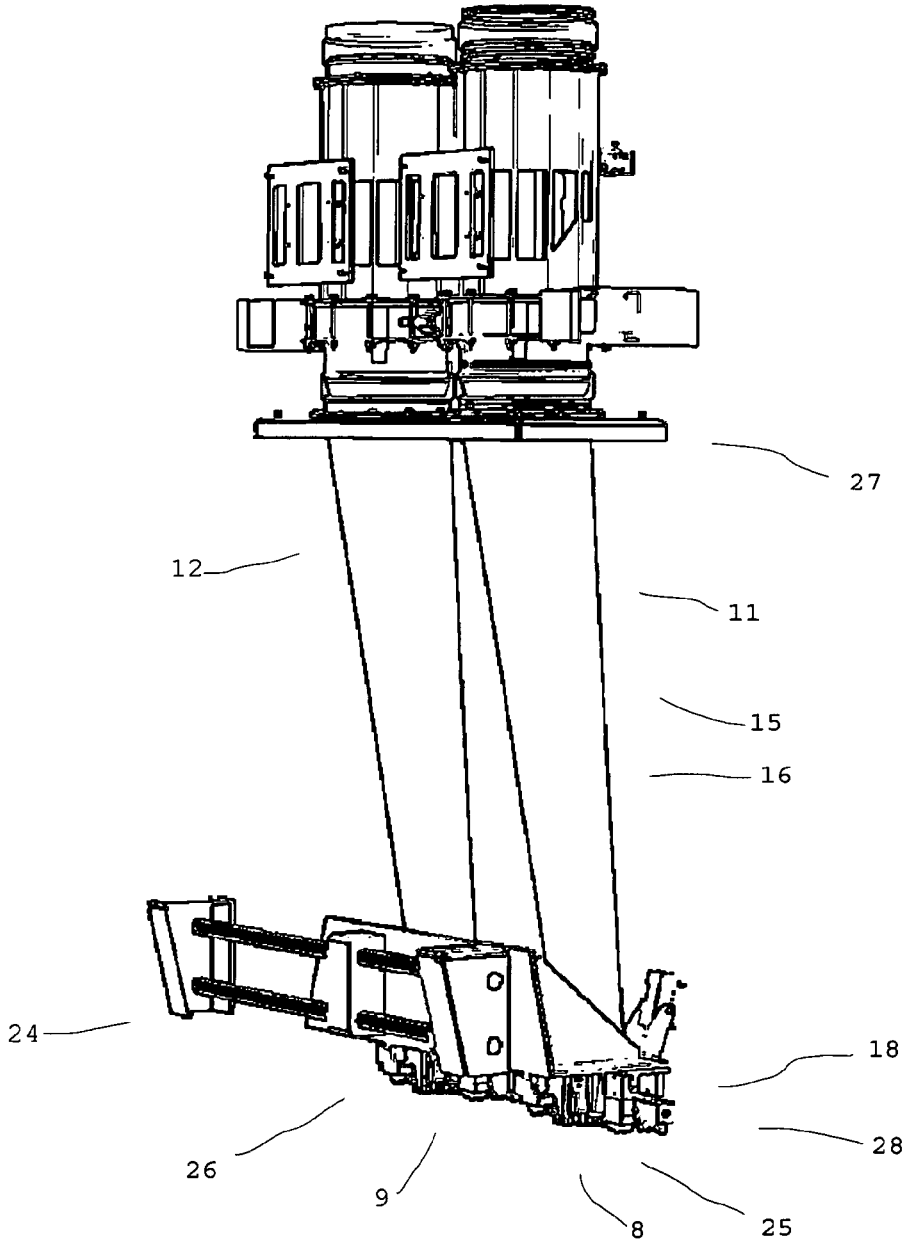

FIG. 5 illustrates a pair of product feeding devices 11 and 12 at least portions of which are configured flexible. The filling channels configured in particular flexible are fixedly positioned at the upper end 27 while due to the flexibility of the filling channels 15 the lower ends 28 can be moved sidewardly to shift the selected filling port to the filling position 26.

On the whole the invention provides a packaging system which allows fast and efficient product changes. At the same time the structural and financial charges involved are minor.

LIST OF REFERENCE NUMERALS

1 packaging system
2 packaging machine
3 bulk materials
4 open bag
5 blown sheet reservoir
6 bag forming device
7 sack attachment device
8 filling port
9 filling port
10 filling port
11 product feeding device
12 product feeding device
13 product feeding device
14 bag discharging device
15 filling channel
16 acceleration channel
17 gross weighing machine
18 clamping device
19 net weighing machine
20 silo
21 silo
22 silo
23 door
24 traversing device
25 cleaning position
26 filling position
27 upper end
28 lower end
29 compensator
30 vibrating device

The invention claimed is:

1. A packaging system having a packaging machine for filling bulk materials into open bags and a sack attachment device for attaching the open bags to a filling port of a product feeding device and filling with at least one bulk material, characterized in that at least two selectable product feeding devices are assigned to the sack attachment device and the at least two product feeding devices and the sack attachment device are positioned movable relative to one another to select a product feeding device and by means of the sack attachment device to attach a sack to the filling port of the selected product feeding device and to fill bulk materials into the open sack by means of the associated filling port; wherein the packaging machine is traversable from at least one first product feeding device provided with a filling port to at least one second product feeding device provided with a filling port.

2. The packaging system according to claim 1 wherein the packaging machine is equipped with a blown sheet reservoir, a bag forming device, the sack attachment device, and in particular also with a bag discharging device.

3. The packaging system according to claim 1 wherein the packaging machine is equipped with a bag picking device for picking preformed bags.

4. The packaging system according to claim 1 wherein the product feeding device comprises a filling channel and said filling port.

5. The packaging system according to claim 1 wherein a gross weighing machine is assigned at least to the filling port of one product feeding device.

6. The packaging system according to claim 1 wherein at least one product feeding device is provided with clamping devices to retain an open bag to be filled at the filling port during filling.

7. The packaging system according to claim 1 wherein at least one product feeding device comprises a net weighing machine and an acceleration line is mounted downstream of the net weighing machine.

8. The packaging system according to claim 1 wherein at least one product feeding device is provided stationary at a silo.

9. The packaging system according to claim 1 wherein the packaging machine comprises doors which are closed during filling and are open while the packaging machine is traversing from the first product feeding device to the second product feeding device.

10. The packaging system according to claim 1 wherein at least one product feeding device comprises a filling valve and/or wherein at least one vibrating device is provided and/or at least one separate sealing station is or are provided.

* * * * *